United States Patent [19]

Weir

[11] Patent Number: 4,738,440

[45] Date of Patent: Apr. 19, 1988

[54] LAUNDRY FOLDING UNIT

[76] Inventor: Henry J. Weir, Bulwark, Chepstow, Gwent NP6 5QZ, Wales, Wales

[21] Appl. No.: 57,779

[22] Filed: Jun. 3, 1987

Related U.S. Application Data

[63] Continuation of Ser. No. 768,029, Aug. 21, 1985, abandoned.

[30] Foreign Application Priority Data

Aug. 22, 1984 [GB] United Kingdom ..... 8421346

[51] Int. Cl.[4] ..... B42C 1/00

[52] U.S. Cl. ..... 270/45; 493/405; 493/423; 493/441

[58] Field of Search ..... 270/45; 493/405, 406, 493/408, 416, 417, 423, 424, 441

[56] References Cited

U.S. PATENT DOCUMENTS

| | | | |
|---|---|---|---|
| 3,154,726 | 10/1964 | McClain | 493/441 |
| 3,642,270 | 2/1972 | Patton, Jr. | 493/423 |
| 3,684,274 | 8/1972 | Grantham et al. | 270/45 |
| 3,744,785 | 7/1973 | Grantham | 270/45 |
| 3,980,290 | 9/1976 | Sjoman et al. | 493/441 |
| 4,614,512 | 9/1986 | Capdeboseq | 493/423 |
| 4,650,173 | 3/1987 | Johnson et al. | 270/45 |
| 4,678,173 | 7/1987 | Basinger et al. | 270/45 |
| 4,682,977 | 7/1987 | Buxton | 493/441 |

FOREIGN PATENT DOCUMENTS

| | | | |
|---|---|---|---|
| 2610778 | 9/1977 | Fed. Rep. of Germany | 493/441 |
| 2944638 | 5/1981 | Fed. Rep. of Germany | 493/441 |
| 1063226 | 4/1954 | France | 493/441 |
| 516222 | 12/1939 | United Kingdom | 493/423 |

*Primary Examiner*—Eugene H. Eickholt

*Attorney, Agent, or Firm*—Russell E. Hattis; Stephen R. Arnold

[57] ABSTRACT

A laundry folding unit comprises a transfer conveyor on to which laundry articles are fed by a bridge mechanism from a feed conveyor. At the appropriate time the transfer conveyor is braked momentarily to allow a fold line of the article to be caught in the nip between the feed conveyor and a fold roller. Bypass is effected either by failure to operate the bridging mechanism or by failure to stop the transfer conveyor, which leads the article back to the feed path of the machine.

19 Claims, 5 Drawing Sheets

LAUNDRY FOLDING UNIT

This application is a continuation of application Ser. No. 768,029, filed 8/21/85, now abandoned.

The invention relates to a laundry folding unit, particularly for flat-work articles such as sheets, table-cloths etc.

In the interests of efficient laundry processing it is customary to use multi-lane machines in which, say, three or four parallel lanes of small pieces, such as napkins, can be dealt with simultaneously in parallel. Adjacent lanes should be capable of operating together to process wider articles which may occupy two or more lanes. An article may need to be laterally folded once or twice, or not at all.

Accordingly, there is a requirement for a laundry folding unit for receiving articles to be folded from an ironing machine, which unit can be combined with another for single or double folds; by-passed when no fold is required; and which is capable of running independently or in conjunction with parallel units to give the facility of flexible multi-lane operation.

Existing folding mechanisms often employ features which disturb the article and cause it to fold unevenly or introduce creases. For example, air jets are often used to direct an article. These cause severe disturbance to small and light fabric articles, are critical as far as variations in weight and thickness are concerned, and tend to be inaccurate.

Another technique sometimes employed is the sudden reversal of the direction of a conveyor. This can cause slippage of some kinds of fabrics, giving rise to measurement inconsistencies. On high-speed machines the timing requirements for the conveyor reversals is extremely critical and it is almost impossible to achieve consistent and accurate folding of articles of different fabrics.

Other mechanisms sometimes employed include plate devices which insert a fold line of an article into the nip of contra-rotating rollers. Another arrangement includes hinged plates or blades to which free-running wheels or rollers are mounted. The article is guided over the mechanism and at the appropriate time the plate or blade is raised and the free-running wheels or rollers engage with an overhead contra-rotating roller which grips a portion of the article causing it to reverse and pass folded under the plate mechanism. On high speed machines the mechanical movements become noisy and unstable. Also, the weight of the mechanisms makes it difficult to synchronise a number for combined operation of several lanes of a multi-lane machine.

By-pass arrangements are also often complicated and unsatisfactory. The present invention seeks to provide an improved folding system.

According to the invention there is provided a laundry folding unit in the feed path of articles in a laundry machine, the unit comprising a feed conveyor on which articles to be folded are received; a roller which runs against the feed conveyor to present a folding nip therewith; a transfer conveyor located above the roller; drive means for driving the transfer conveyor at least as fast as the feed conveyor and in the same direction; a bridging mechanism operable to feed articles from the feed conveyor to the transfer conveyor, the transfer conveyor being arranged to transfer articles from the feed conveyor and on to the feed path of the machine beyond the roller to bypass the roller if desired; a brake for stopping the transfer conveyor; and a timing mechanism responsive to the passage of an article through the machine, the arrangement being such that (a) a fold in an article may be effected by operating the bridging mechanism to feed the leading part of the article on to the transfer conveyor, withdrawing the bridging mechanism and braking the transfer conveyor to allow the feed conveyor to continue to feed the trailing part of the article towards the roller so that a fold line of the article is caught in the folding nip and the article is drawn therethrough and thus folded or (b) the folding stage may be bypassed by allowing the article to be fed forward on the transfer conveyor.

With this arrangement no rapid movement is made to the article. When the transfer conveyor stops, the leading portion of the article stops regardless of its texture.

Double folds or multiple folds may be effected by arranging a second or further fold units similar to the first further along the feed path for the articles. Preferably the feed conveyor has a downwardly inclined portion and the said roller runs against this downwardly inclined portion. It is to be understood that the downwardly inclined portion, although preferable, is not essential. The preferred unit of the present invention is compact and allows units to be arranged one immediately above the next. Thus, two or more lateral folds may be made, and it is important to note that the mechanism is particularly suitable for making one-third folds.

The unit readily gives the type of fold which folds the article with the side in contact with the feed conveyor (in practice the ironed side), and which delivers it with the edges underneath after two folds have been made. From the point of view of neatness and customer acceptability this type of fold is best.

By virtue of the simplicity of the fold mechanism and the requirement simply to brake without reversing, the drive arrangement required can be so simplified that adjacent units can be assembled side by side across a multi-lane machine to operate independently or together.

The drive mechanism may comprise a shaft running across the machine to which one of each of the transfer conveyor rollers is clutched when drive is required. However, a preferred alternative is to drive the transfer conveyor via frictional co-operation with a drive conveyor running over said roller. When the brake is operated the transfer conveyor slips on the drive conveyor.

The bridging mechanism is preferably a set of fingers displaceable to project between bands of the feed conveyor.

The braking mechanism is preferably an electromagnetic brake acting on a roller over which the transfer conveyor passes.

The invention will further be described with reference to the accompanying drawings, of which:

Figure 3:
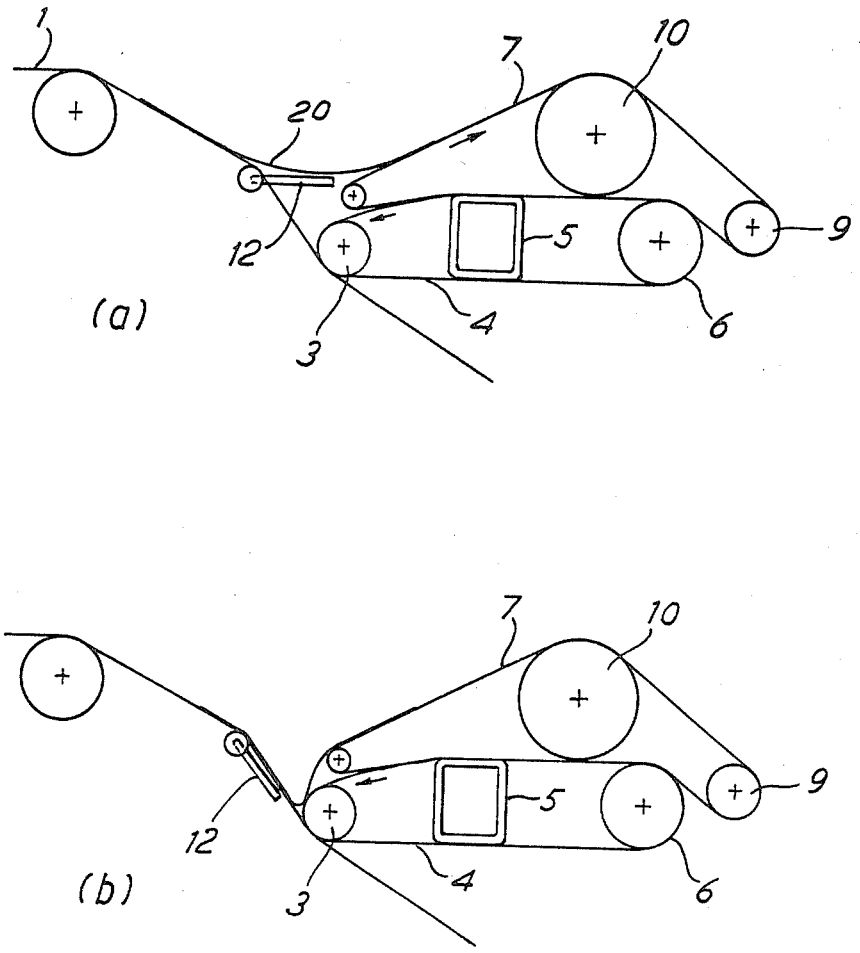
Figure 4:
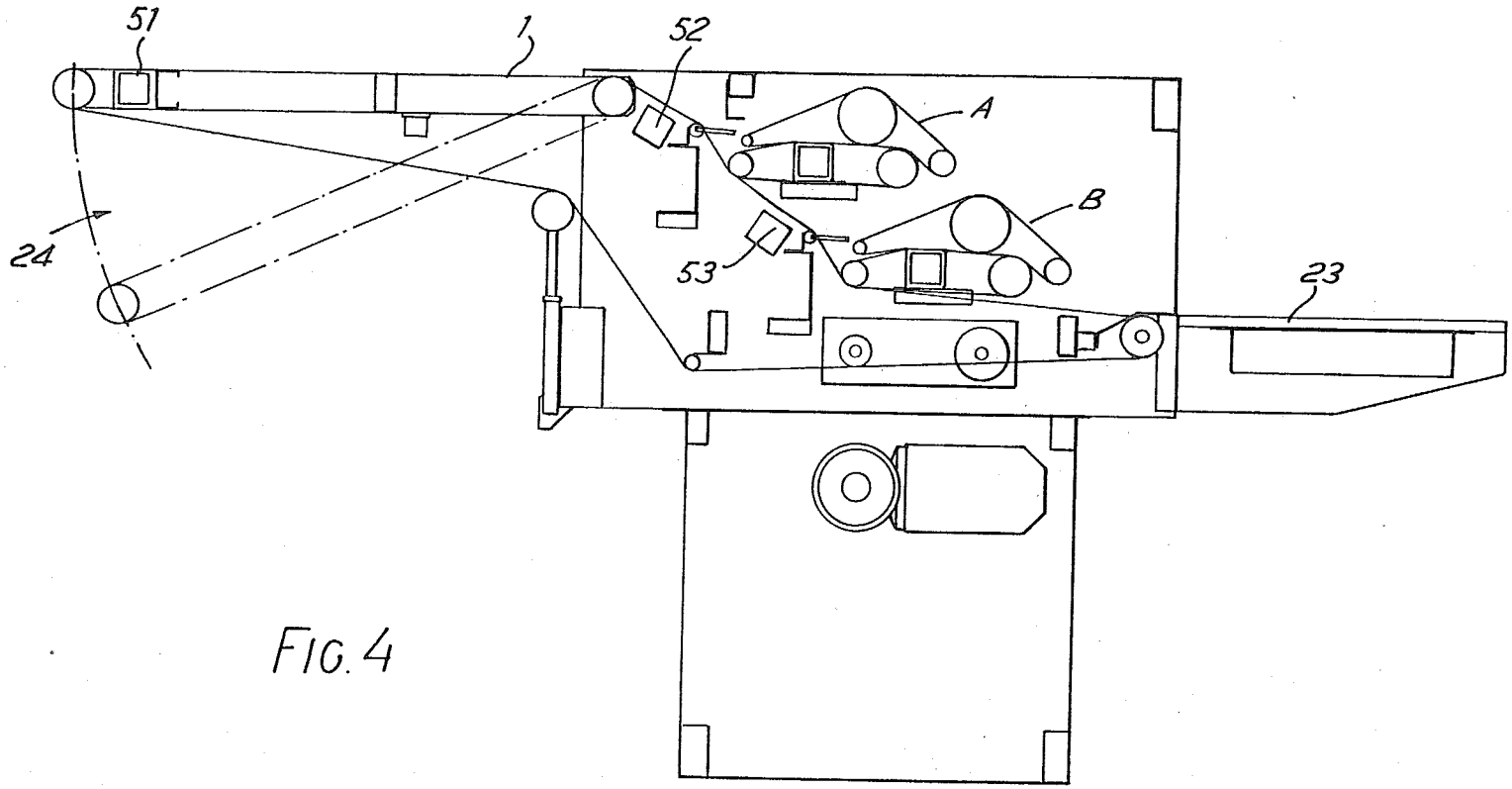
Figure 5:
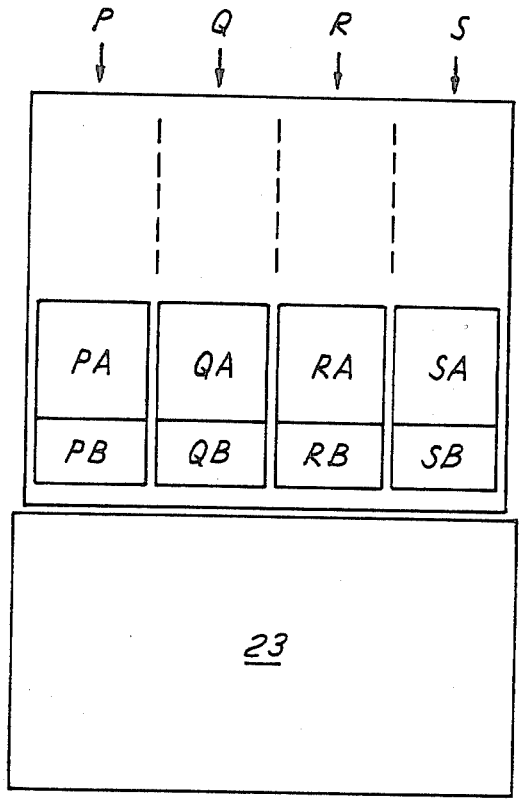

FIGS. 3(*a*) and 3(*b*) are diagrams illustrating the folding operation of the unit;

FIG. 4 is a side elevation of a machine incorporating units of the kind described with reference to FIGS. 1 to 3; and FIG. 5 is a schematic diagram for illustrating the use of the units in a multi-lane machine.

Figure 1:
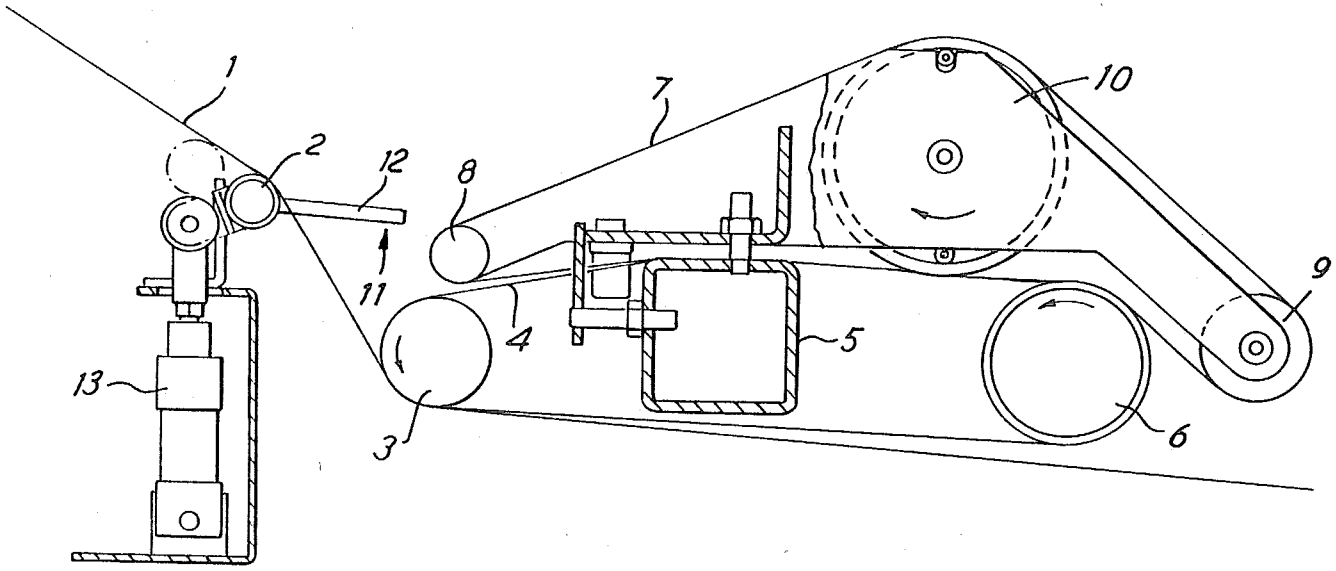
FIG. 1 is a side elevation of a folding unit according to the invention.

Referring to FIG. 1 the unit comprises a feed conveyor 1 along which are fed articles to be folded. Conveyor 1 consists of a set of parallel bands with spaced between, and runs over a guide 2 and a folding roller 3. The folding roller is the end roller of a drive conveyor 4 which passes over a tubular support 5 and around another end roller 6.

Mounted on the tubular support 5 is a transfer conveyor 7 which runs around two end rollers 8 and 9 and a large brake roller 10. Drive conveyor 4 is positively driven by a drive shaft and transfer conveyor 7 is driven by contact with the drive conveyor.

A fold gap 11 exists between the feed conveyor 1 and the transit conveyor 7, and a bridging mechanism is provided to controllably bridge the gap when required. The bridging mechanism comprises a set of fingers 12 which in the position shown project between the bands of conveyor 1. The fingers are mounted to pivot about the axis of guide 2 and are moved between the bridging position shown and a related position where they lie beneath the conveyor belt 1 by means of a pneumatic ram 13.

Figure 2:
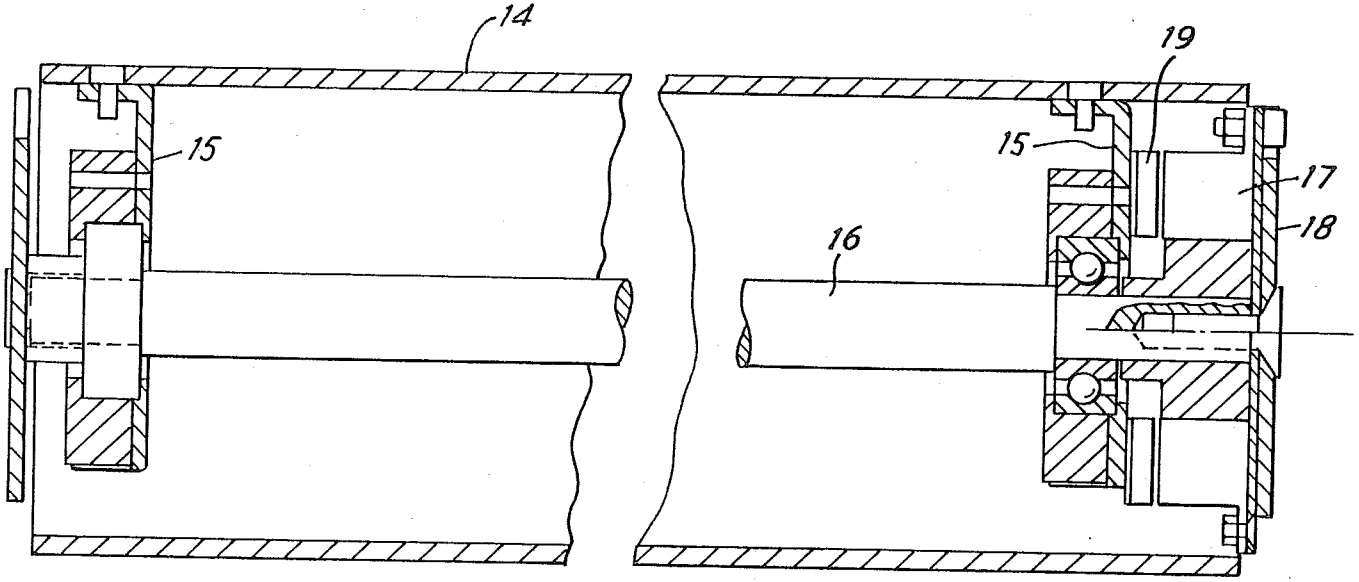
FIG. 2 is a cross-section of the braking roller of FIG. 1.

Referring now to FIG. 2 there is shown roller 10 in cross-section. The roller is a hollow tube 14 mounted on end brackets 15 which rotate on a spindle 16. At one end there is an electromagnetic brake an armature 17 which is fixed to the frame of the machine by an anchor plate 18. A brake plate 19 is coupled to one of the rotary brackets 15. Operation of the brake attracts the brake plate to the armature and stops the roller.

Operation of the folding unit described above is illustrated in FIG. 3. A timing mechanism (not shown in FIG. 3) detects the article 20 to be folded and measures its length and position. As shown in FIG. 3*a* the bridging fingers 12 are operated to bridge the gap to the transfer conveyor and the leading edge of the article is thus fed on to the transfer conveyor. After a time determined by the timing mechanism the brake of roller 10 is operated. This stops the conveyor which then slips with respect to the drive conveyor.

As shown in FIG. 3*b* the bridging mechanism is operated to withdraw the fingers and open the fold gap just prior to the braking of the transfer conveyor and the trailing part of the article is fed down by the feed conveyor to form a loop which tucks into the folding nip between the feed conveyor and the folding roller 3. As soon as the article is held in the folding nip, the brake can be released and the transfer conveyor restarted. This can be after a very short delay—perhaps as little as 100 mSec. The article will be drawn back against the drag of the restarted transfer conveyor and in many circumstances this actually reduces frictional resistance and helps draw out creases. The article is thus drawn between the feed conveyor and the folding roller and a fold is effected. It will be seen that the article may be laterally folded at any required point depending on the setting of the timing mechanism. Usually articles will be folded in half, but the system is suitable for forming a one-third fold, for example.

Referring now to FIG. 4 there is shown the arrangement of two units of the kind shown in FIG. 1 in a machine for effecting two folds successively if necessary. The folding units are illustrated generally at A and B. The feed conveyor serves both Units A and B and finally delivers the laundry articles to a delivery table 23.

An important feature of the invention is the bypass facility, which can be seen from FIG. 4. Normally, the bridging fingers are in the lowered position. Thus, if the bridging fingers are not operated, either deliberately because no fold is required or accidentally because the article has missed being detected by the measuring sensors, then the article passes on through the folding nip and is not folded. In these circumstances continuous running of the machine is not impeded. This is a fail-safe feature. Alternatively, an article can be deliberately by-passed around a fold station by raising the bridging fingers and feeding it to the transfer conveyor. However, in the by-pass mode the transfer conveyor is not stopped and instead of the article being drawn back between the feed conveyor and the folding roller the article is carried over the braking roller 10 and fed from Unit A to unit B or from unit B back to the feed conveyor 1 and thence to the delivery table. A useful feature of this by-pass mode is that it can be employed for a long article, the trailing part of which may still be engaged in a previous and slower machine, for example an ironer. The leading part of the article may slip relative to the transfer conveyor. If, on the other hand, such an article were by-passed through the folding nip, the positive pull on the article may cause tearing. Thus, it will be seen that by appropriate control an article may be folded once, twice, or not at all. With this arrangement by-pass is effected merely by control of the bridging fingers and non-activation of the brake. No physical movement of substantial components is necessary.

FIG. 4 shows the positions of the sensing switches of the turning mechanism. The switches can be mechanical micro-switches or optical switches, for example. Two sensor switches S1 and S2 are located prior to the first fold station A. The switches detect the leading and trailing edges of an article. They are connected to a measuring circuit which in known manner determines the length of the article, and also the position of the required fold line, whether it be half, quarter or third the way along the article, for example.

As the article approaches the transfer conveyor and is detected by switch S2 the bridging finger mechanism is operated. When the fold line of the article as determined by the measuring circuit reaches the appropriate position the bridging fingers are retracted and the conveyor brake is applied. At this point the article forms a loop and the fold line is conveyed into the folding nip. The brake is released and the fold cycle completed. Brake release can be effected a short fixed time after brake operation, to allow for the fold line to be engaged in the folding nip.

When the measuring circuit is adjusted to establish the half-length of an article, the article will be folded in half. To fold in thirds, the control is adjusted to establish the leading third length and make the first fold. This is followed by a half-length measurement to make the second fold. The article is then folded to one third of its size. For the second fold station, only one additional switch, S3, is required, since the length of the article has already been established by the first two sensors and the measuring circuit.

Simultaneous parallel operation of folding units in adjacent lanes of a multi-lane machine can be achieved as follows. Switching sensors are located on the conveyor between the lanes. When an article is wide enough to contact these sensors the respective lanes are automatically combined for simultaneous operation. Alternatively the selection to combine lanes can be made manually by the machine operator from a control panel.

It will be seen from FIG. 4 that there is provided a height-adjustable lead-in portion 24 for conveyor 1 whereby the folder may be adapted to receive articles from ironing machine with different heights of discharge.

In FIG. 5 there is shown the machine of FIG. 4 in schematic plan view, to illustrate the multi-lane operation. The feed conveyor 1 and delivery table are four lanes wide. For convenience the individual conveyor bands are not shown. The lanes are marked P,Q,R,S. Each lane has an independent pair of folding units A and B, marked PA, PB etc., with associated independent measuring and timing equipment. Thus, it is possible to run four independent parallel lanes simultaneously for small pieces. Alternatively, the lanes can be run as two pairs, one pair and two singles, one triple and one single or one quadruple width lane. No complicated coupling or uncoupling is necessary for this, since the necessary drive in the embodiment described is taken by friction from the feed conveyor and the timing controls can be effective to operate the bridging fingers and conveyor brakes independently or in unison.

I claim:

1. A laundry folding unit in the feed path of articles in a laundry machine, the unit comprising a feed conveyor on which articles to be folded are received; a downwardly inclined portion of the feed conveyor; a roller which runs against the downwardly inclined portion of the feed conveyor to present a folding nip therewith; a transfer conveyor located above the roller; drive means for driving the transfer conveyor at least as fast as the feed conveyor and in the same direction; a bridging mechanism operable to feed articles from the feed conveyor to the transfer conveyor, the transfer conveyor being arranged to transfer articles from the feed conveyor and on to the feed path of the machine beyond the roller to bypass the roller if desired; a brake for stopping the transfer conveyor; and a timing mechanism responsive to the passage of an article through the machine, the arrangement being such that (a) a fold in an article may be effected by operating the bridging mechanism to feed the leading part of the article on to the transfer conveyor, withdrawing the bridging mechanism and braking the transfer conveyor to allow the feed conveyor to continue to feed the trailing part of the article towards the roller so that a fold line of the article is caught in the folding nip and the article is drawn therethrough and thus folded or (b) the folding stage may be bypassed by allowing the article to be fed forward on the transfer conveyor.

2. A laundry folding unit as claimed in claim 1 wherein the feed conveyor has a downwardly inclined portion against which said roller runs.

3. A laundry folding unit as claimed in claim 1 or claim 2 wherein the drive means for driving the transfer conveyor comprises a drive conveyor which runs over said roller and which frictionally engages the transfer conveyor, operation of the brake causing slip between the drive conveyor and the transfer conveyor.

4. A laundry folding unit as claimed in claim 1 or 2 combined with at least one other folding unit as claimed therein, said folding units being arranged side by side in respective lanes to be operable independently or together.

5. A laundry folding unit as claimed in claim 1 or 2 combined with at least one other folding unit as claimed therein for effecting successive lateral folds in an article.

6. A laundry folding machine comprising:

a feed conveyor to be driven in a given feeding direction and adapted to receive thereon articles which are to be folded;

a roller disposed to run against a portion of said feed conveyor to present a folding nip therewith;

a fold-forming transfer conveyor;

drive means for driving said transfer conveyor in said given direction;

a bridging mechanism operable between a first position to feed articles from said feed conveyor to said transfer conveyor, and a second position allowing said article to remain on said feed conveyor;

brake means for stopping said transfer conveyor; and control means including timing means responsive to the passage of an article through said folding unit for folding an article by operating said bridging mechanism to said first position to feed the leading part of said article onto said transfer conveyor, thereafter operating said bridging mechanism to said second position and braking said transfer conveyor to allow said feed conveyor to continue to feed the trailing part of the article towards said roller so that a fold line of the article is caught in the folding nip and said article is drawn therethrough and from said transfer conveyor.

7. The laundry folding machine of claim 6 wherein said transfer conveyor is configured to convey an article emplaced thereon to a chosen destination when said bridging mechanism is maintained in said first position thereof by said control means so as to prevent said catching of said article in said folding nip.

8. The laundry folding unit of claim 7 wherein said transfer conveyor is disposed so as to place said destination at a portion of said feed conveyor at a point downstream of said roller so that articles may bypass said roller and thereafter be returned to said feed conveyor.

9. The laundry folding machine of claim 8 where at least the lead portion of said transfer conveyor proximate to said bridging means is disposed generally above said roller.

10. The laundry folding machine of claim 9 wherein at least a portion of said feed conveyor proximate to said bridging mechanism is disposed to be downwardly inclined so as to feed a portion of said article downward as a loop to be engaged by said roller.

11. The laundry folding machine of claim 8 where at least the lead portion of said transfer conveyor proximate to said bridging means is disposed generally above said roller, and wherein at least a portion of said feed conveyor proximate to said bridging mechanism is disposed to be downwardly inclined so as to feed a portion of said article downward as a loop to be engaged by said roller.

12. The laundry folding machine of claims 7, 10, or 11 wherein said control means governs the transfer of said article during a folding operation so that at least a portion of said article remains constantly supported on said feed conveyor during folding without removal therefrom.

13. The laundry folding machine of claim 7 combined with at least one other folding unit as claimed therein, and wherein said destination point is chosen to be a portion of the transfer conveyor of said other folding unit.

14. The plurality laundry machines of claim 13 wherein the feed conveyors of said machines are configured as a single common conveyor.

15. A laundry folding unit as claimed in claim 7 wherein the drive means for driving said transfer conveyor includes continuous friction coupling means for coupling said transfer conveyor to said feed conveyor and operable to a condition decoupling drive motion to said transfer conveyor upon actuation of said brake means.

16. The laundry folding unit of claim 15 wherein said transfer conveyor is configured as a first continuous belt, said friction coupling means including a second friction belt driven synchronously with said feed conveyor and means for holding said first and second belts into frictional engagement with each other.

17. The laundry folding unit of claim 16 wherein said brake means is disposed to act directly upon said transfer conveyor.

18. A laundry folding unit as claimed in claims 7, 8, 11, 13, 14, or 17 combined with at least one other folding unit as claimed therein, said folding units being arranged side by side in respective lanes to be operable independently or together.

19. A laundry folding unit as claimed in claims 7, 8, 11, 13, 14, or 17 serially combined with at least one other folding unit as claimed therein for effecting successive lateral folds in an article.

* * * * *